US005120286A

United States Patent [19]

Twohig

[11] Patent Number: 5,120,286

[45] Date of Patent: Jun. 9, 1992

[54] TRAINING DEVICE FOR SKATERS

[76] Inventor: David G. Twohig, 40 Presley St., Malden, Mass. 02148

[21] Appl. No.: 622,492

[22] Filed: Dec. 3, 1990

[51] Int. Cl.[5] ..... A63B 3/04; A61H 3/00

[52] U.S. Cl. ..... 482/66; 482/93; 482/114; 482/139

[58] Field of Search ..... 272/70.3, 70, 127, 97, 272/115; 135/65, 66; 297/5; 280/87.05

[56] References Cited

U.S. PATENT DOCUMENTS

| | | | |
|---|---|---|---|
| 1,727,969 | 9/1929 | Evans | 272/70.3 |
| 3,709,515 | 1/1973 | Kilcullen | 280/87.051 |
| 4,005,859 | 2/1977 | Tait | 272/70.3 |
| 4,021,033 | 5/1977 | Audair | 272/70.3 |
| 4,411,283 | 10/1983 | Lucarelli | 297/5 |
| 5,013,032 | 5/1991 | Baum | 272/70.3 |

FOREIGN PATENT DOCUMENTS

| | | | |
|---|---|---|---|
| 1562100 | 2/1969 | France | 272/70.3 |

*Primary Examiner*—Richard J. Apley
*Assistant Examiner*—Jerome Donnelly
*Attorney, Agent, or Firm*—John P. McGonagle

[57] ABSTRACT

A skating aid with a broad weighted bottom portion having an undersurface formed into a horseshoe shaped runner. A hollow upper portion with external handles fits into the bottom portion. The invention overall height is adjustable by a peg arrangement which determines the depth into which the upper portion seats into the lower portion.

17 Claims, 3 Drawing Sheets

TRAINING DEVICE FOR SKATERS

BACKGROUND OF THE INVENTION

This invention relates to training aids and, more particularly, to a device for use in training young ice skaters.

Most children experience difficulty in initially learning to ice skate. To the beginner ice skates are very unstable and falls are often sudden and severe. Once a child has taken a bad fall, he or she often becomes afraid and may abandon further efforts to learn to skate or, at least, they become so cautious that the learning process becomes a lengthy one.

In general, persons learning to skate feel a good deal more secure if they are able to hold on to someone, particularly a more experienced skater, to prevent falling. However, in many instances a good skater is not available or they do not have the time and patience required to teach a beginner. In lieu of another skater, a skating aid of some sort is most often used.

For years, parents, instructors and youth hockey coached have tried to find the perfect skating aid. They have used chairs and even milk crates tied together to coax young inexperienced skaters onto the ice. But most skating aids are "makeshift" and not fully adequate.

SUMMARY OF THE INVENTION

In view of the foregoing disadvantages inherent in the known types of devices now present in the prior art, the present invention provides an improved skating aid. It is specifically designed for novice skaters. It gives the beginner optimum support as well as providing increased safety. It is practical, adjustable and easy to carry. As such, the general purpose of the present invention, which will be described subsequently in greater detail, is to provide a new and improved training aid for young skaters.

To attain this, the present invention provides an aid with a broad weighted bottom portion having an undersurface formed into a horseshoe shaped runner. A hollow upper portion with external handles fits into the bottom portion. The inventions overall height is adjustable by a peg arrangement which determines the depth into which the upper portion seats into the lower portion.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
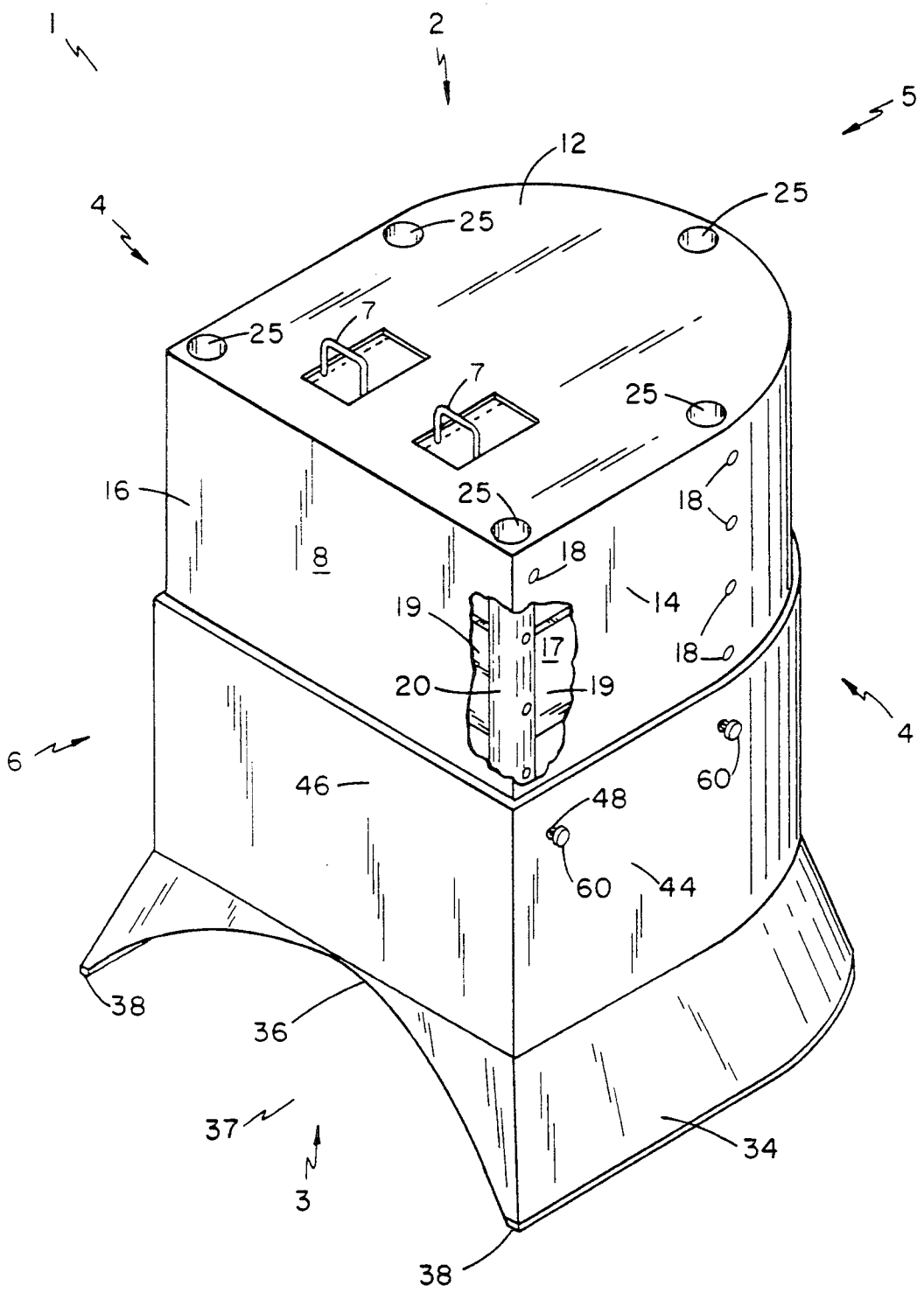
FIG. 1 is a perspective view of the present invention.
Figure 2:
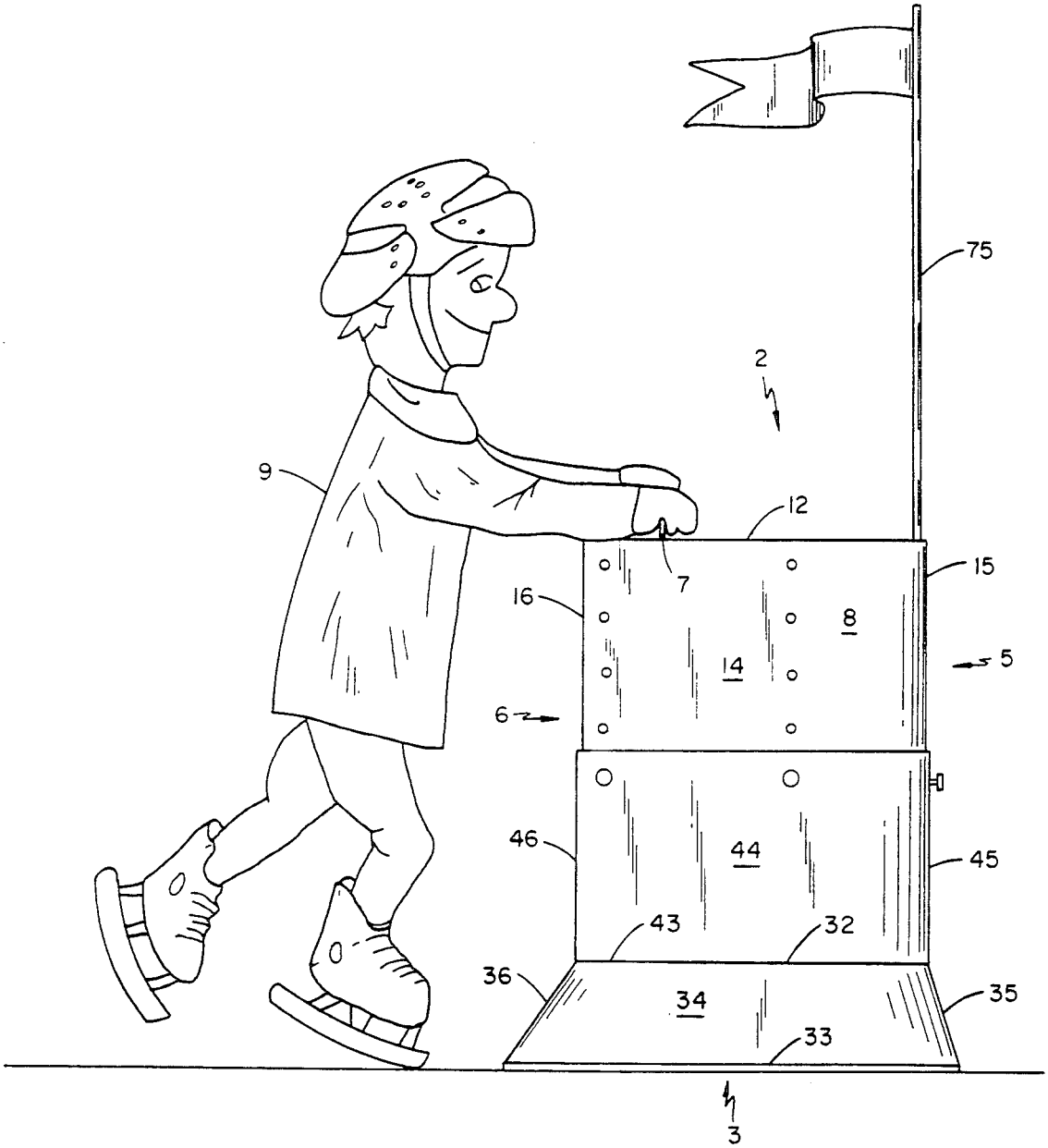
FIG. 2 is a side view of the present invention being used by a skater.
Figure 3:
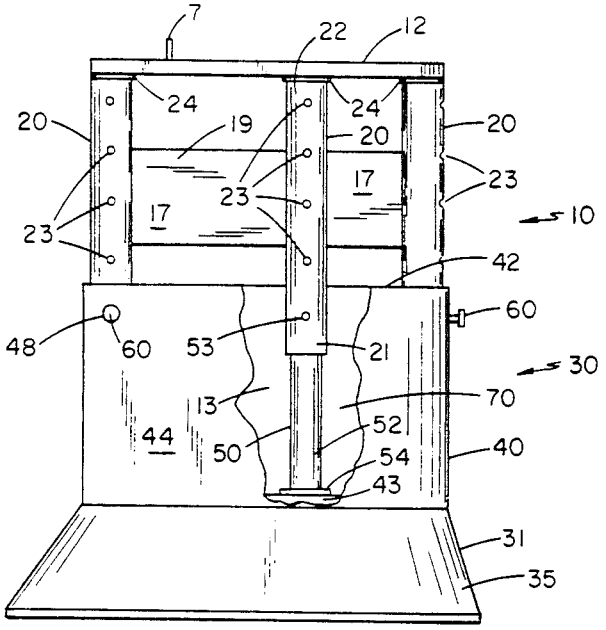
FIG. 3 is a side plan view, partly in section, of the present invention without the vinyl cover.
Figure 4:
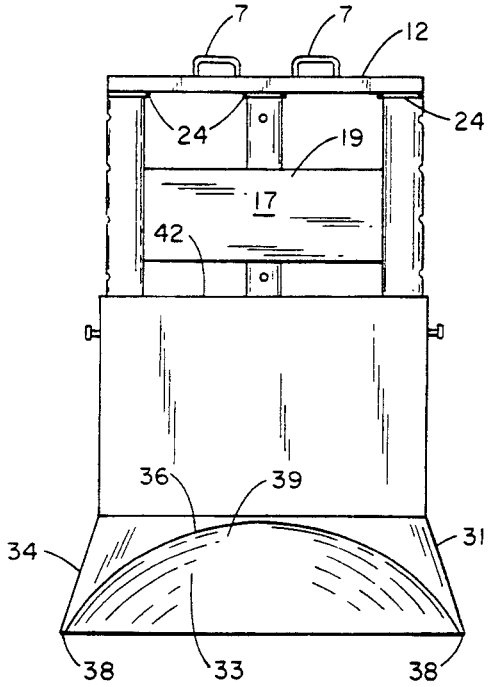
FIG. 4 is a rear view thereof.
Figure 5:
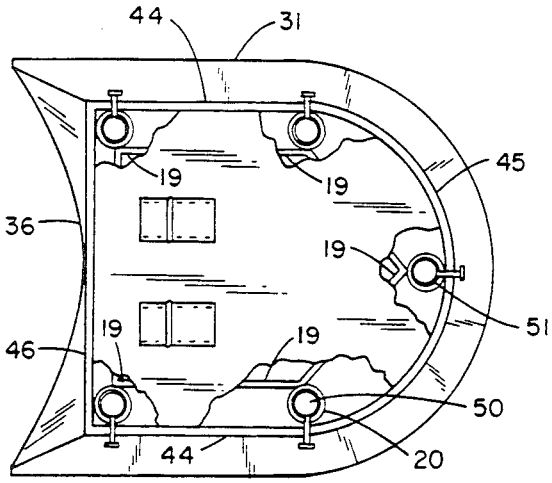
FIG. 5 is a top view thereof, partly in section.

Referring to the drawings in detail wherein like elements are indicated by like numerals, there is shown a training aid 1 for skaters 9 incorporating the priciples of the present invention. The training aid 1 has a top 2, bottom 3, two sides 4, front 5 and rear 6. The training aid front 5 is outwardly rounded in this embodiment. In use the novice skater 9 would position himself or herself at the invention rear 6 holding onto two handles 7 positioned on top 2 of the training aid 1.

The training aid 1 is comprised of two major elements, an upper portion 10 and a lower portion 30. The lower portion 30 is divided into a box-like element 40 mounted on and attached to a bottom element 31. The box 40 has a generally rectangular shape with a longitudinal axis running from front 45 to rear 46. The bottom element front 35 and sides 34 extend outwardly from top 32 to bottom 33. The bottom element rear 36 is inwardly rounded in a convex shape. The bottom element 31 is weighted thereby making the invention 1 more stable and less likely to tip. The bottom element undersurface 33 is shaped along its side 34 and front 35 circumference into a downwardly extending, runner-like, rounded ridge 38 formed into a horseshoe-shaped runner. The central portion 39 of the bottom element under-surface 33 extending to the rear 36 is upwardly curved thereby completing the ridge formation and also forming a rear space 37 to avoid interfering with a skater's stride.

The box-like element 40 is mounted on the bottom element 31 whereby the box-like element bottom 43 forms the bottom element top 32. The box-like element top 42 is open. Five hollow poles 50 are vertically positioned within the box-like element 40. The poles 50 have radial flanges 54 at one end 52 and are attached by means of said flanges 54 to the interior floor 43 of the box 40 near to the junctions of the rear and sides 46, 44, front and sides 45, 44, and centrally at the front 45. The unattached ends 51 of the poles 50 are flush with the box element top 42. Each pole 50 has a double radial opening 53 corresponding to openings 48 in the box-like element sides 44 and front 45.

In the preferred embodiment, the lower portion 30 has a height of eighteen inches, a length of from twenty-four to twenty-eight inches, and a width of eighteen inches. The lower portion 30 is made out of a hard plastic but could be made out of any other material which is rigid and light weight.

The upper portion 10 has an overall shape roughly corresponding to the shape of the lower portion box-like element 40 but with slightly smaller width and length dimensions. The upper portion 10 is comprised of a framework 19 enclosed by a vinyl covering 8 about its sides 14, front 15 and rear 16. The upper portion top 12 is a solid, generally flat surface with hand grips 7 which are parallel to the upper portion rear 16 and are adjustable in a forward 15 or rearward 16 direction. The upper portion bottom 13 is open. The framework 19 is comprised of five hollow, vertical poles 20 positioned at and forming the junctions of the rear and sides 16, 14, front and sides 15, 14, and centrally at the front 15. Each pole 20 has a radial flange 24 at one end 22 and is attached by means of said flange 24 to the upper portion top 12. The pole unattached ends 21 extend vertically downward and are flush with the upper portion bottom 13. Each of the poles 20 are hollow and have five double radial openings 23. The vinyl covering 8 has openings 18 corresponding to the double radial openings 23 of the poles 20. Horizontal bracing 17 interconnects the poles 20 thereby providing strength and rigidity to the framework 19 while maintaining a desired overall lightness.

The diameter of the upper portion poles 20 is slightly larger than the diameter of the lower portion poles 50. The upper portion 10 is fitted into the lower portion box-like element 40 so that the upper portion poles 20 concentrically slide over the lower portion poles 50. Height adjustment of the invention 1 is accomplished by aligning one level of upper portion pole double radial openings 23 with the double radial openings 53 of the lower poles 50. Once the desired height is selected and alinment is made, capped pegs 60 are slid individually through each box-like element side and front opening 48, through a corresponding covering opening 18, into the first of the upper portion radial openings 23, through the double radial openings 53 of the lower portion poles 50, and then through the second of the upper portion radial openings 23. The peg arrangement permits overall invention height adjustments from eighteen inches to thirty inches. At eighteen inches the upper portion 10 is completely seated within the lower portion box-like element 40 and can be easily carried. The lower portion box-like element 40 and upper portion 10 form an interior cavity 70 which is useful for storage of skates when not in use and for shoes, boots and the like when in use. The hollowness of the invention 1 is a substantial contributor to the invention's overall lightness. The poles 20, 50 in the invention are made out of a hard plastic, aluminum, or materials with similar strength to weight characteristics. The upper portion top surface 12 and the box-like element floor 43 in this embodiment are made of a hard plastic. They could also be made of aluminum or a similar material.

In this embodiment, openings 25 are formed in the upper portion top 12. These openings 25 have the same dimensions as, and radially abut, the radial openings of the attached ends 22 of the upper portion hollow, vertical poles 20. This permits flags, pennants, and the like, on poles 75 to be inserted into the training aid top 2 as desired.

It is understood that the above-described embodiment is merely illustrative of the application. Other embodiments may be readily devised by those skilled in the art which will embody the principles of the invention and fall within the spirit and scope thereof.

I claim:

1. A training device for skaters comprising:

a hollow weighted lower portion having an open top and an undersurface formed into a horseshoe-shaped runner said horseshoe-shaped runner aides in the horizontal mobility of the device, when said runner is in contact with a slick, horizontally positioned surface and said device is moved across said horizontal surface a hollow upper portion with a solid top fitted into said lower portion;

two hand grips attached to said upper portion top; and adjustment means for controlling the depth into which said upper portion is fitted into said lower portion.

2. A training device in accordance with claim 1 wherein said lower portion is comprised of:

a bottom element having a top, bottom, sides, front and rear; and a box-like element, having an open top, bottom, sides, front and rear, mounted on and attached to said bottom element whereby the box-like element bottom forms the bottom element top.

3. A training device in accordance with claim 2 wherein:

said bottom element front and sides extend outwardly from top to bottom.

4. A training device in accordance with claim 3 wherein:

said bottom element is weighted.

5. A training device in accordance with claim 4 wherein:

said bottom element bottom has an undersurface which is shaped along its side and front circumference into a downwardly extending, runner-like, rounded ridge.

6. A training device in accordance with claim 5 wherein:

the central portion of the bottom element undersurface extending to the rear is upwardly curved.

7. A training device in accordance with claim 6 wherein:

the box-like element contains a plurality of vertically positioned poles therein attached to said element bottom.

8. A training device in accordance with claim 7 wherein:

said upper portion has a top, open bottom, sides, front and rear, and has an overall shape corresponding to the shape of the lower portion box-like element but with slightly smaller width and length dimensions.

9. A training device in accordance with claim 8 wherein:

said upper portion is comprised of a framework enclosed by a covering about its sides.

10. A training device in accordance with claim 9 wherein:

said framework contains a plurality of hollow, vertical poles positioned at and forming the junctions of the rear and sides, front and sides, and centrally at the front.

11. A training device in accordance with claim 10 wherein:

each pole has two ends, one of which is attached to said upper portion top and the other of which extends vertically downward and is flush with the upper portion bottom.

12. A training device in accordance with claim 11 wherein:

the upper portion poles have diameters larger than the diameters of the lower portion poles.

13. A training device in accordance with claim 12 wherein:

said upper portion is fitted into the lower portion box-like element so that the upper portion poles concentrically slide over the lower portion poles.

14. A training device in accordance with claim 13 wherein said adjustment means is comprised of:

openings is said box-like element sides and front;

double radial openings in each box-like element pole corresponding to said openings in the box-like element sides and front;

a plurality of double radial openings in each upper portion pole;

a plurality of openings in said covering corresponding to the openings in said upper portion poles; and a plurality of capped pegs whereby height adjustment of is accomplished by aligning one level of upper portion pole double radial openings with the double radial openings of the lower poles, and sliding individual pegs through each box-like element side and front opening, through a corresponding covering opening, into the first of the upper portion radial openings, through the double radial openings of the lower portion poles, and then through the second of the upper portion radial openings.

15. A training device in accordance with claim 14 further comprising:

horizontal bracing interconnecting said upper portion poles.

16. A training device in accordance with claim 15 wherein:

said hand grips are adjustable in a forward or rearward direction.

17. A training device in accordance with claim 16 wherein:

said upper portion top is a solid, generally flat surface having openings which radially abut the radial openings of the attached ends of the upper portion hollow, vertical poles.

* * * * *